US011918058B2

(12) United States Patent
Lucas Gaus et al.

(10) Patent No.: US 11,918,058 B2
(45) Date of Patent: Mar. 5, 2024

(54) SINGLE-PIECE PAD INSERT FOR BRAS

(71) Applicant: NIKE, Inc., Beaverton, OR (US)

(72) Inventors: Vanessa L. Lucas Gaus, Aloha, OR (US); Nicole Rendone, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/840,319

(22) Filed: Jun. 14, 2022

(65) Prior Publication Data

US 2022/0304396 A1 Sep. 29, 2022

Related U.S. Application Data

(62) Division of application No. 16/554,791, filed on Aug. 29, 2019, now Pat. No. 11,406,141.

(60) Provisional application No. 62/731,194, filed on Sep. 14, 2018.

(51) Int. Cl.

| | |
|---|---|
| ***A41C 3/14*** | (2006.01) |
| ***A41C 3/00*** | (2006.01) |
| ***A41C 3/10*** | (2006.01) |

(52) U.S. Cl.

CPC ..... *A41C 3/144* (2013.01); *A41C 3/0035* (2013.01); *A41C 3/10* (2013.01)

(58) Field of Classification Search

CPC ..... A41D 1/22
USPC ..... 450/89, 36, 57
See application file for complete search history.

(56) References Cited

U.S. PATENT DOCUMENTS

| | | | |
|---|---|---|---|
| 147,264 | A | 2/1874 | Hodgkins |
| 162,869 | A | 5/1875 | Tallman |
| 862,376 | A | 8/1907 | Bachman |
| 1,018,066 | A | 2/1912 | Mayer et al. |
| 1,391,936 | A | 9/1921 | Sadie |
| 2,289,679 | A | 7/1942 | Porter |
| 2,420,575 | A | 5/1947 | Treadwell |
| 2,435,860 | A | 2/1948 | Lewis et al. |
| 2,436,430 | A | 2/1948 | Hart |
| 2,492,862 | A | 12/1949 | Harvey |
| 2,498,487 | A | 2/1950 | Solomon |
| 2,503,847 | A | 4/1950 | Shanahan |
| 2,505,720 | A | 4/1950 | Josephine et al. |
| 2,524,028 | A | 10/1950 | Bordner |

(Continued)

FOREIGN PATENT DOCUMENTS

| | | | |
|---|---|---|---|
| CN | 204015146 | U | 12/2014 |
| GB | 2445725 | A | 7/2008 |

(Continued)

OTHER PUBLICATIONS

Patent Translate machine translation of JP 3208013 U, provided by Espacenet on Dec. 27, 2022 (Year: 2022).*

(Continued)

*Primary Examiner* — Jocelyn Bravo
(74) *Attorney, Agent, or Firm* — Shook, Hardy & Bacon L.L.P.

(57) ABSTRACT

Aspects herein are directed to a bra system comprising a single-piece pad insert and a bra having a front portion with a pocket in communication with a pocket space formed between two textile layers used to form the front portion of the bra. The single-piece pad insert is used to provide shaping, modesty and support. When desired, a wearer can insert the pad insert into the bra by way of the pocket opening.

12 Claims, 10 Drawing Sheets

(56) References Cited

U.S. PATENT DOCUMENTS 2,563,241 A 8/1951 Herbener
2,585,338 A 2/1952 Meares
2,611,129 A 9/1952 Jules
2,628,356 A 2/1953 Rosenfield et al.
3,568,681 A 3/1971 Comollo
4,100,621 A 7/1978 Ettipio
4,363,144 A 12/1982 Goad
4,607,640 A * 8/1986 McCusker ..... A41C 3/0057 450/1
4,816,005 A 3/1989 Braaten
5,022,887 A 6/1991 Lawson
5,024,628 A 6/1991 Sanchez
5,060,648 A 10/1991 Zarkesh
5,690,536 A 11/1997 Madden et al.
5,690,537 A 11/1997 Kalmus
5,769,688 A 6/1998 Holliday
5,839,942 A 11/1998 Miller
5,850,745 A 12/1998 Albright
5,983,394 A 11/1999 Joo
D419,279 S 1/2000 Marco et al.
6,083,080 A 7/2000 Lawson et al.
6,110,005 A 8/2000 Stephenson et al.
6,176,761 B1 1/2001 Underhill
6,296,545 B1 10/2001 Chen
6,302,760 B1 10/2001 Dai
6,306,006 B1 10/2001 Cheng
6,406,352 B1 6/2002 Cheng
6,431,945 B1 8/2002 Stephens et al.
6,443,805 B1 9/2002 Kirkwood
6,517,410 B1 2/2003 Underhill
6,659,841 B2 12/2003 Raimondo
6,688,942 B2 * 2/2004 Holliday ..... A41C 3/142 450/39
6,863,589 B2 3/2005 Cano
6,983,489 B2 1/2006 Caprio
7,081,034 B1 7/2006 Zoellner
7,241,199 B2 7/2007 Huang
7,381,113 B2 6/2008 Hori
7,458,877 B2 12/2008 Yu
7,585,200 B1 9/2009 Mclaren
7,731,564 B2 6/2010 Sanders
7,739,753 B2 6/2010 Jankowski
7,776,019 B2 8/2010 Kawakami et al.
7,794,304 B2 9/2010 Frye
7,887,389 B1 2/2011 Lacambra
7,913,520 B1 * 3/2011 Chen ..... D04B 1/16 66/196
8,029,332 B2 10/2011 Nadsady et al.
8,047,891 B1 11/2011 Albritton
8,100,848 B2 1/2012 Wilkes et al.
8,128,457 B2 3/2012 Reinisch et al.
8,419,503 B2 4/2013 Zhang
8,597,072 B1 12/2013 Lucas
8,657,643 B2 2/2014 Perez
8,840,442 B2 9/2014 Linkon
8,870,624 B2 10/2014 Hopkins
8,898,816 B2 12/2014 Highfield
8,911,415 B2 12/2014 Knapp
8,911,416 B2 12/2014 Johnson
8,926,398 B1 1/2015 Mendeleev et al.
9,289,016 B1 3/2016 Goff
9,295,288 B1 3/2016 Goff
9,370,206 B1 6/2016 Ellington
9,943,120 B1 4/2018 Rendone
10,010,117 B1 * 7/2018 Rendone ..... A41C 3/0057
10,117,785 B2 11/2018 Marquez
10,231,492 B1 * 3/2019 Bastug ..... A41C 3/10
10,448,679 B1 10/2019 Roddis et al.
10,721,974 B2 7/2020 Bastug
10,786,016 B2 9/2020 Caden
10,798,977 B1 10/2020 Ransom
10,905,173 B1 2/2021 Kosak et al.
2002/0062512 A1 5/2002 Gustafson et al.
2003/0181129 A1 9/2003 Getman
2004/0142631 A1 7/2004 Luk
2004/0224603 A1 * 11/2004 Kaye ..... A41C 3/10 450/1
2005/0020183 A1 1/2005 Falla
2005/0266770 A1 12/2005 Henricksen
2006/0010577 A1 1/2006 Sarikelle
2006/0057937 A1 3/2006 Bowler
2006/0223415 A1 10/2006 Watrin et al.
2007/0083180 A1 4/2007 Sakaguchi et al.
2007/0155283 A1 7/2007 Mcqueer
2007/0249263 A1 10/2007 Itzhak
2007/0281586 A1 12/2007 Pritchard
2007/0287977 A1 12/2007 Fujikawa et al.
2008/0026676 A1 1/2008 Rothman et al.
2008/0032600 A1 2/2008 Updyke
2008/0090491 A1 4/2008 Liu
2008/0153387 A1 6/2008 Liu
2008/0261489 A1 10/2008 Sweeney
2009/0126413 A1 * 5/2009 Sorensen ..... A61F 13/04 66/196
2009/0181600 A1 7/2009 Liu
2009/0203295 A1 8/2009 Kassel
2009/0265830 A1 10/2009 Hendrickson
2009/0265831 A1 10/2009 Hendrickson
2010/0056022 A1 3/2010 Liu
2010/0075575 A1 * 3/2010 Pardo ..... A41C 3/10 450/86
2010/0285722 A1 11/2010 Liu
2011/0153016 A1 6/2011 Izzo et al.
2012/0021668 A1 1/2012 Lyman
2012/0046627 A1 2/2012 Agnew
2012/0064799 A1 3/2012 Rivers
2013/0303051 A1 11/2013 Chan
2014/0349550 A1 11/2014 Campbell
2015/0044943 A1 2/2015 Marshall et al.
2016/0366951 A1 12/2016 Pisani
2017/0013887 A1 1/2017 Lilien
2017/0172220 A1 6/2017 Sung
2017/0247816 A1 * 8/2017 Kornas ..... A61F 2/52
2017/0273365 A1 9/2017 Muhlenfeld
2018/0132542 A1 5/2018 Abbaszadeh
2018/0242653 A1 8/2018 Brandt et al.
2018/0255839 A1 9/2018 David
2018/0332904 A1 11/2018 Rendone
2018/0344487 A1 * 12/2018 Mommers-Mccaffrey ..... A41B 1/08
2019/0174841 A1 6/2019 Bastug
2020/0085113 A1 3/2020 Rendone
2020/0397069 A1 12/2020 Liu

FOREIGN PATENT DOCUMENTS

GB 2520235 A 5/2015
JP 63-85606 A 4/1988
JP S63-85606 U 6/1988
JP 9-157913 A 6/1997
JP 3208013 B2 11/2016
JP 3208013 U * 12/2016
KR 100817304 B1 * 3/2008 ..... A41C 3/08
KR 10-1770013 B1 8/2017
TW M240833 U 8/2004
WO 2012/039455 A1 3/2012
WO 2016/006541 A1 1/2016
WO 2017/191806 A1 11/2017
WO WO-2017191806 A1 * 11/2017 ..... A41C 3/10

OTHER PUBLICATIONS

Machine Translation of KR100817304 B1, provided on Jul. 6, 2023 via Espacenet Patent Translate (Year: 2023).*
Machine Translation of WO2017191806 A1, provided on Jul. 6, 2023 via Espacenet Patent Translate (Year: 2023).*
Office Action received for Canadian Patent Application No. 3112844, dated Jun. 9, 2022, 4 pages.
Best Nursing Bras for Breastfeeding Moms 2018, Mommyhood101 ™, mommyhood101.com, Available online at-https://mommyhood 101 .com/best-nursing-bras-2018, Accessed Jul. 2018.

(56) References Cited

OTHER PUBLICATIONS

Cache Coeur Women's Illusion Seamless Nursing Bra, Target, target.com, Available online at-https://www.targel.com/p/cache-coeur-women-s-illusion-seamless-nursing-bra/-/A-50502021, Accessed Jul. 2018.

Serenity Comfort Nursing Bra with Seamless Healing Pocket and Removable Molded Pads-medium by Nizo Wear (Large, Black), Amazon, amazon.com, Asin: Boocownags, Item model number: blackL, Available online at-https://www.amazon.com/Serenity-Removable-Pads-medium-Nizo-Wearidp/BOOCOWNAGS, Accessed Jul. 2018.

Office Action received for Canadian Patent Application No. 3,112,844, dated Feb. 8, 2023, 4 pages.

Office Action received for European Patent Application No. 19768982.1, dated Mar. 9, 2023, 8 pages.

* cited by examiner

SINGLE-PIECE PAD INSERT FOR BRAS

CROSS-REFERENCE TO RELATED APPLICATIONS

This application, entitled "Single-Piece Pad Insert for Bras," is a divisional application of U.S. application Ser. No. 16/554,791, filed Aug. 29, 2019, and entitled, "Single-Piece Pad Insert for Bras, which claims the benefit of priority of U.S. Prov. App. No. 62/731,194, filed Sep. 14, 2018, and entitled "Single-Piece Pad Insert for Bras." The entireties of the aforementioned applications are incorporated by reference herein.

TECHNICAL FIELD

Aspects herein relate to a support garment having a single-piece pad insert for modesty, shaping, and support.

BACKGROUND

Traditional pad inserts for bras used to provide shaping or modesty generally comprise separate pad inserts for the left bra cup and the right bra cup that are insertable using small openings positioned on the sides of the bra. It is often difficult to correctly position or re-position the pad inserts due to the small openings, and once positioned, the pad inserts often become displaced during wear and/or during washing. Moreover, because two separate inserts are used, a wearer may be more likely to lose one of the inserts.

DESCRIPTION OF THE DRAWINGS

Examples of aspects herein are described in detail below with reference to the attached drawing figures, wherein.

DETAILED DESCRIPTION

Figure 1:
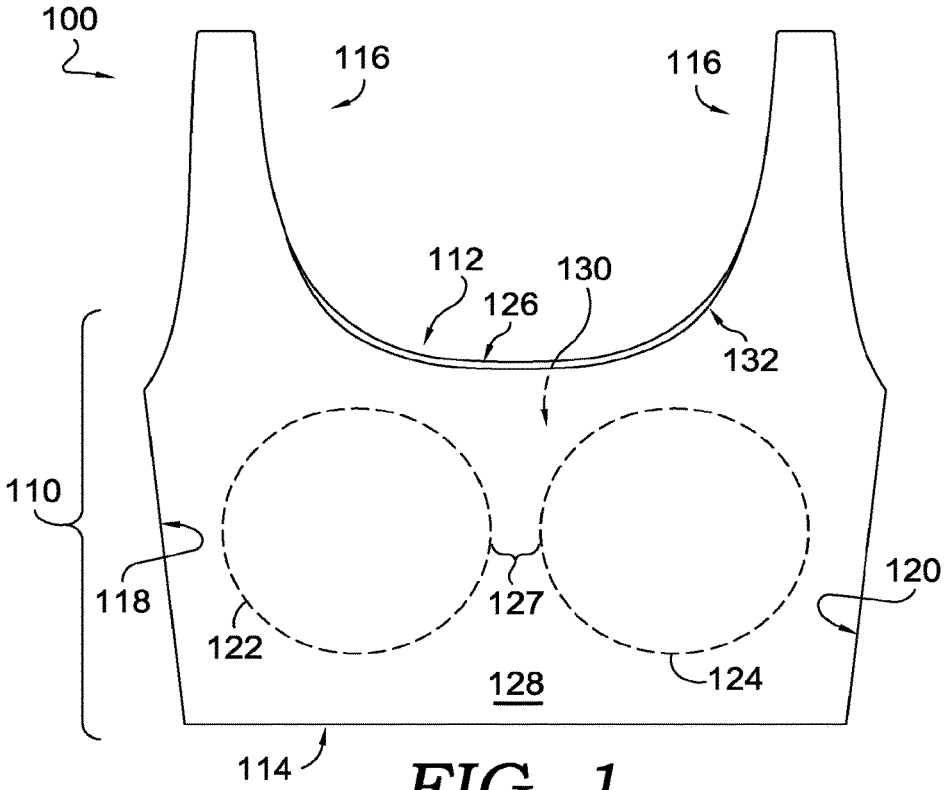
FIG. 1 illustrates a front view of a bra with a pocket opening located at an upper margin of a front portion of the bra in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein are directed to a bra system comprising a single-piece pad insert and a bra with a front portion formed from a first textile layer and a second textile layer. The front portion of the bra has one or more pocket openings in communication with a pocket space formed between the first and second textile layers of the front portion. In one example aspect, the bra comprises a pocket opening positioned at an upper margin of the front portion. And in another example aspect, the bra comprises a first pocket opening located at a first or right side of the front portion and/or a second pocket opening located at a second or left side of the front portion. The single-piece pad insert is configured to be positioned within the pocket space by way of the pocket openings.

Continuing, the single-piece pad insert comprises a single or unitary pad formed from first and second layers of material and an elastically deformable pad portion positioned between the first and second layers and having a first breast-contacting surface and a second breast-contacting surface. The single-piece pad insert is sized to substantially fill the pocket space formed between the first and second textile layers of the front portion of the bra. In example aspects, the single-piece pad insert comprises a central portion extending between the first breast-contacting surface and the second breast-contacting surface of the pad insert. In further example aspects, the single-piece pad insert may include material extensions that extend from each side of the pad insert and terminate in a right side margin and a left side margin of the pad insert. The material extensions help to more securely seat the pad insert when it is positioned within the pocket space of the bra and are configured to partially curve around the sides of wearer when the bra and pad insert system is utilized by the wearer. Both the central portion and the material extensions may include the elastically deformable pad portion positioned between the first and second layers, but the elastically deformable pad portion in these areas may have a minimal thickness (i.e., less than or equal to about 5 mm) to minimize the weight of the pad insert and to improve flexibility of the pad insert.

By having the pad insert comprise a single piece—as opposed to two separate pads—the pad insert is easier to manipulate by a wearer (due to, for instance, its larger size) and is less likely to be misplaced or lost. In example aspects, the elastically deformable pad portion comprises an open cell foam for breathability, and the first and second layers of material comprise a mesh construction to enhance the breathability achieved by using an open cell foam for the elastically deformable pad portion of the pad insert. In other example aspects, the pad insert may be formed from a spacer mesh material having first and second layers (which may comprise a mesh construction) interknitted with tie yarns. Similar to using an open cell foam, use of a spacer mesh material enables moisture vapor to travel through the material.

When a wearer desires more modesty, shaping, and/or support than is achieved by using the bra alone, the wearer can removably insert the single-piece pad insert into the bra by way of the pocket opening(s) so that it is positioned between the first and second textile layers of the front portion of the bra. Because of the lightweight construction of the single-piece pad insert along with the breathability characteristics achieved by using, for instance, an open cell foam or spacer mesh material and a mesh construction, wearer comfort and/or performance is maintained when the pad insert is utilized. When the wearer no longer wishes to use the single-piece pad insert, the wearer can remove the pad by way of the pocket opening(s). Once removed, the pocket space can be used to stow additional items such as, for example, identification cards, phones, keys, and the like.

Accordingly, aspects herein are directed to a bra system comprising a bra having a front portion. The front portion comprises a first textile layer, a second textile layer positioned adjacent to the first textile layer to define a pocket space between the first textile layer and the second textile layer, and a pocket opening in communication with the pocket space, the pocket opening positioned at an upper margin of the front portion. The bra system additionally comprises a single-piece pad comprising a first layer of material, a second layer of material, and an elastically deformable pad portion positioned between the first layer of material and the second layer of material to form a first breast-contacting surface and a second breast-contacting surface of the single-piece pad insert, where the single-piece pad insert is configured to be positioned in the pocket space of the front portion of the bra by insertion through the pocket opening.

In another example, aspects herein are directed to a bra system comprising a bra having a front portion comprising a first textile layer, a second textile layer positioned adjacent to the first textile layer to define a pocket space between the first textile layer and the second textile layer, a first pocket opening in communication with the pocket space, the first pocket opening positioned at a first side margin of the front portion, and a second pocket opening in communication with the pocket space, the second pocket opening positioned at a second side margin of the front portion. The bra system additionally comprises a single-piece pad insert comprising a first layer of material, a second layer of material, and an elastically deformable pad portion positioned between the first layer of material and the second layer of material to form a first breast-contacting surface and a second breast-contacting surface of the single-piece pad insert, where the single-piece pad insert is configured to be positioned in the pocket space of the front portion of the bra by insertion through one or more of the first pocket opening and the second pocket opening.

In yet another example, aspects herein are directed to a method using a bra having a single-piece pad insert. The method comprises providing a bra having a front portion comprising: 1) a first textile layer, 2) a second textile layer positioned adjacent to the first textile layer to define a pocket space between the first textile layer and the second textile layer, and 3) at least one pocket opening in communication with the pocket space. The method additionally comprises providing a single-piece pad insert comprising: 1) a first layer of material, 2) a second layer of material, 3) and an elastically deformable pad portion positioned between the first layer of material and the second layer of material to form a first breast-contacting surface and a second breast-contacting surface. The method further comprises inserting the single-piece pad insert into the pocket space by way of the pocket opening so that the single-piece pad insert is positioned between the first textile layer and the second textile layer of the bra.

The term "bra" as used herein is meant to encompass any number of support garments such as bras, sport bras, tank tops, camisoles with built-in support, swimming suit tops, body suits, and other styles or types of support garments used to support breast tissue. Further, the term "breast contacting surface" as used herein is meant to encompass any type of structure that is in contact with or positioned adjacent to (though not necessarily in contact with) the wearer's breasts when the support garment is worn. In example aspects, and for a typical wearer, a bra and/or single-piece pad insert would comprise a first breast contacting surface configured to contact or be positioned adjacent to, for instance, a wearer's right breast and a second breast contacting surface configured to contact or be positioned adjacent to, for instance, a wearer's left breast. In example aspects, the bra may comprise a unitary or continuous band of material (molded or unmolded) that makes contact with both of the wearer's breasts. Any and all aspects, and any variation thereof, are contemplated as being within aspects herein.

Positional terms as used herein to describe a bra or support garment such as "front," "back," "upper," "lower," "bottom," "inner-facing surface," "outer-facing surface," and the like are with respect to an appropriately sized bra or support garment being worn as intended and as shown and described herein by a wearer standing in an upright position. The phrase "configured to contact," or other similar phrases used when describing different portions of the bra or support garment in relation to a wearer refer to a bra or support garment appropriately sized and dimensioned for the particular wearer. Terms such as "attached," "secured," "affixed," and the like may mean elements that are releasably attached to one another using, for example, snap systems, slider systems, hook-and-loop closure systems, releasable adhesives, buttons, hooks, and the like. These terms may further mean elements that are fixedly attached to one another using, for example, stitching, bonding, welding, and the like.

With respect to the single-piece pad insert, the term "single" means that the pad insert comprises a unitary component configured to cover or be positioned adjacent to both of a wearer's breasts. This is opposed to separate, distinct pad inserts for each of the wearer's breasts (e.g., a first pad insert for the right breast, and a second separate pad insert for the left breast). The term "mesh material" or "mesh construction" when used with respect to the single-piece pad insert may mean a textile having a large number of closely spaced holes. Aspects herein contemplate that the mesh material may be formed from a loosely knitted or woven textile, or the mesh material may be formed by perforating a textile in a post-weaving or post-knitting step to form the holes.

Continuing with respect to the elastically deformable pad portion of the single-piece pad insert, the term "elastically deformable" means a material that is able to spontaneously return to a resting shape after compression or distortion. Example materials that are elastically deformable and that are contemplated herein include foams (both closed cell and open cell foams), spacer mesh materials, silicone materials, and the like. The term "open cell" when describing foam materials means a foam material in which generally more than half of the cells walls are disrupted thereby allowing interconnection between the different cells. Due to the interconnection between the different cells, air and/or moisture vapor can generally move through the foam material. The term "spacer mesh material" as used herein is meant to encompass both warp knit and weft knit spacer knit materials as is known in the art of textiles. Spacer knit materials are generally formed by utilizing at least one tie yarn to interknit first and second layers of the textile. More specifically, each of the first layer and the second layer may be knit separately, and the tie yarn(s) is used to connect the first layer and the second layer where the tie yarn may extend generally perpendicular to the surface plane of the first layer and the second layer. For instance, the tie yarns may have "loop" portions that extend into each of the first layer and the second layer where the loop portions are interlooped with yarns in the first layer and the second layer to connect the two layers. The distance between the first layer and the second layer may be varied by, for instance, varying the length of the tie yarn that extends between the first layer and the second layer. Still further with respect to the elastically deformable pad portion, the term "apex portion" means the central region of the first and second breast-contacting surfaces of the pad portion, where the apex portion is generally configured to cover a respective nipple area of a wearer's breast. The term "peripheral portion" means the outer edge or the area near the outer edge of the first and second breast-contacting surfaces of the pad portion.

Turning now to FIG. 1, a front view of a bra 100 is depicted in accordance with aspects herein. In example aspects, the bra 100 comprises a front portion 110 configured to generally cover a wearer's upper front torso when the bra 100 is worn. The front portion 110 comprises an upper margin 112 and a lower margin 114 positioned inferior to the upper margin 112. In example, aspects, the lower margin 114 may comprise an underband portion of the bra 100. A pair of shoulder straps 116 extend from the upper margin 112 where the shoulder straps 116 are configured to extend over a wearer's shoulders when the bra 100 is worn. The bra 100 additionally comprises side portions 118 and 120 that are configured to extend around a wearer's torso when the bra 100 is worn.

With respect to the front portion 110, the front portion 110 comprises a first breast-contacting surface 122 (indicated generally by dashed lines) configured to cover or be positioned adjacent to a wearer's right breast when the bra 100 is worn, and a second breast-contacting surface 124 (indicated generally by dashed lines) configured to cover or be positioned adjacent to a wearer's left breast when the bra 100 is worn. A middle portion 127 extends between the first breast-contacting surface 122 and the second breast-contacting surface 124.

As will be explained in further depth below, in example aspects, the front portion 110 comprises a two-layer construction having a first textile layer 126 and a second textile layer 128 where respective surfaces of the first textile layer 126 and the second textile layer 128 are positioned adjacent to each other to define a pocket space 130 between the first and second textile layers 126 and 128. A pocket opening 132 in communication with the pocket space 130 is positioned at the upper margin 112 of the front portion 110. In example aspects, one or more of the first textile layer 126 and/or the second textile layer 128 may be formed from a textile having stretch and recovery properties (achieved, for instance, using elastic yarns). As will be explained further below, use of textiles having stretch and recovery properties may help provide support to the wearer's breasts and may also help secure the pad insert between the first and second textile layers 126 and 128 when the pad insert is utilized.

Figure 2:
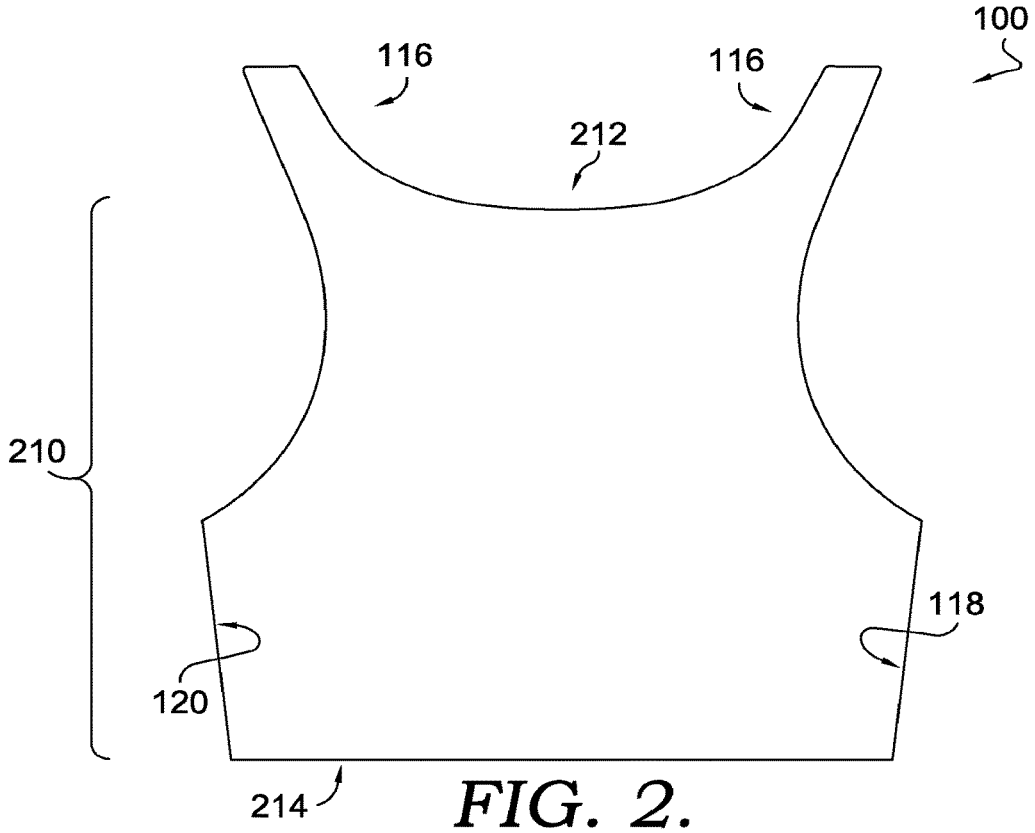
FIG. 2 illustrates a back view of the bra of FIG. 1 in accordance with aspects herein.

Turning to FIG. 2, a back view of the bra 100 is illustrated in accordance with aspects herein. The bra 100 further comprises a back portion 210 configured to cover an upper back torso of a wearer. In example aspects, and as shown in FIG. 2, the back portion 210 may be configured as a racerback style although other styles are contemplated herein. The shoulder straps 116 extend from an upper margin 212 of the back portion 210 and comprise a generally continuous extension of the shoulder straps 116 extending from the upper margin 112 of the front portion 110. Although shown with shoulder straps 116, it is contemplated herein that the bra 100 may not comprise shoulder straps and have a bandeau-style configuration. The back portion 210 further comprises a lower margin 214. In example aspects, the lower margin 214 comprises a circumferential extension of the lower margin 114 of the front portion 110. The bra 100 further comprises the side portions 118 and 120 as shown in FIG. 2. It is contemplated herein that the front portion 110 may integrally extend from the back portion 210 without the use of seams (i.e., the front portion 110 and the back portion 210 are created through a single knitting, weaving, or manufacturing event). It is also contemplated herein that the front portion 110 may comprise a separate pattern piece from the back portion 210 such that the front portion 110 is affixed to the back portion 210 at one or more seam lines generally positioned along the side portions 118 and 120 of the bra 100. Any and all aspects, and any variation thereof, are contemplated as being within aspects herein.

Figure 3:
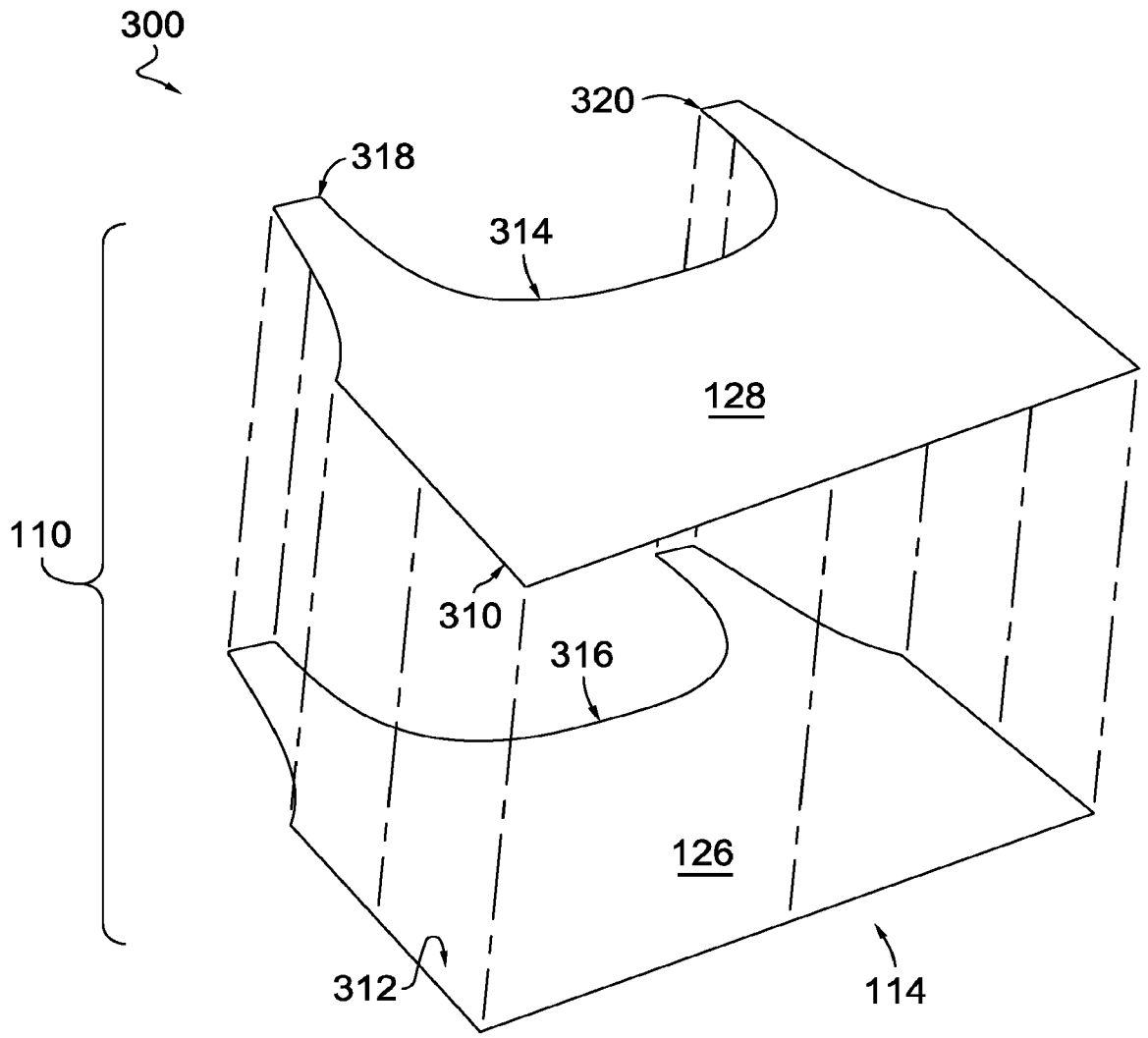
FIG. 3 illustrates an example method of construction of the front portion of the bra of FIG. 1 in accordance with aspects herein.

FIG. 3 illustrates an example method of construction (referenced generally by the numeral 300) of the front portion 110 of the bra 100 in accordance with aspects herein. The front portion 110 comprises the first textile layer 126 and the second textile layer 128. When assembled, the first textile layer 126 is configured to be positioned adjacent to a body surface of a wearer while the second textile layer 128 is configured to be positioned external to the first textile layer 126. To assemble the front portion 110, a surface 310 of the second textile layer 128 is positioned adjacent to a surface 312 of the first textile layer 126, and the second textile layer 128 is affixed to the first textile layer 126 along one or more perimeter edges as generally indicated by the long-and-short lines. For instance, the second textile layer 128 may be affixed to the first textile layer 126 along perimeter edges that form the sides and lower margin 114 of the front portion 110. With respect to this aspect, areas of the front portion 110 that are interior to the perimeter edges are not affixed to one another so that the pocket space 130 is formed between the first and second textile layers 126 and 128. As such, it is contemplated herein that the pocket space 130 may extend generally across an entirety of the front portion 110 from the side portion 118 to the side portion 120.

In one example aspect, an upper edge 314 of the second textile layer 128 may be generally unaffixed from an upper edge 316 of the first textile layer 126 to form the pocket opening 132 to the pocket space 130. To describe this a different way, the upper edge 314 of the second textile layer 128 may be affixed to the upper edge 316 of the first textile layer 126 on both a first side 318 and a second side 320 of an unaffixed portion of the upper edge 314 of the second textile layer 128 where the unaffixed portion comprises the pocket opening 132 to the pocket space 130. As illustrated in both FIGS. 1 and 3, the pocket opening 132 generally extends a length of the upper margin 112 of the front portion 110 to allow for easy insertion and removal of, for example, a single-piece pad insert and/or other items. The attachment points indicated in FIG. 3 and described herein are illustrative only. For example, the front portion 110 may comprise a different shape configuration and may have more or less perimeter edges than shown in FIG. 3.

Figure 4:
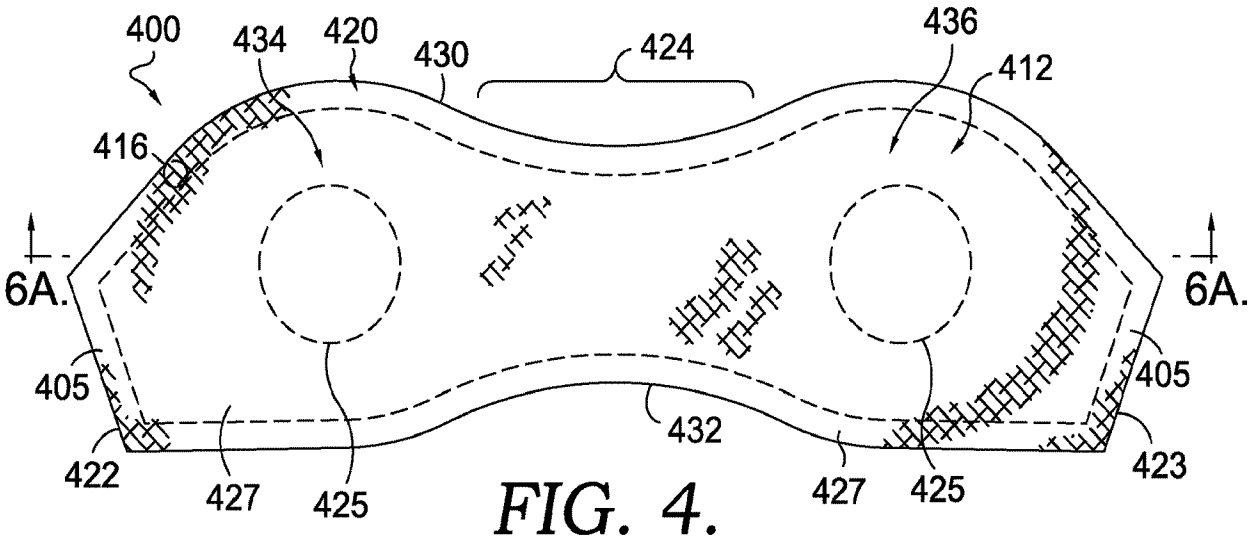
FIG. 4 illustrates a front view of an example single-piece pad insert in accordance with aspects herein.
Figure 5:
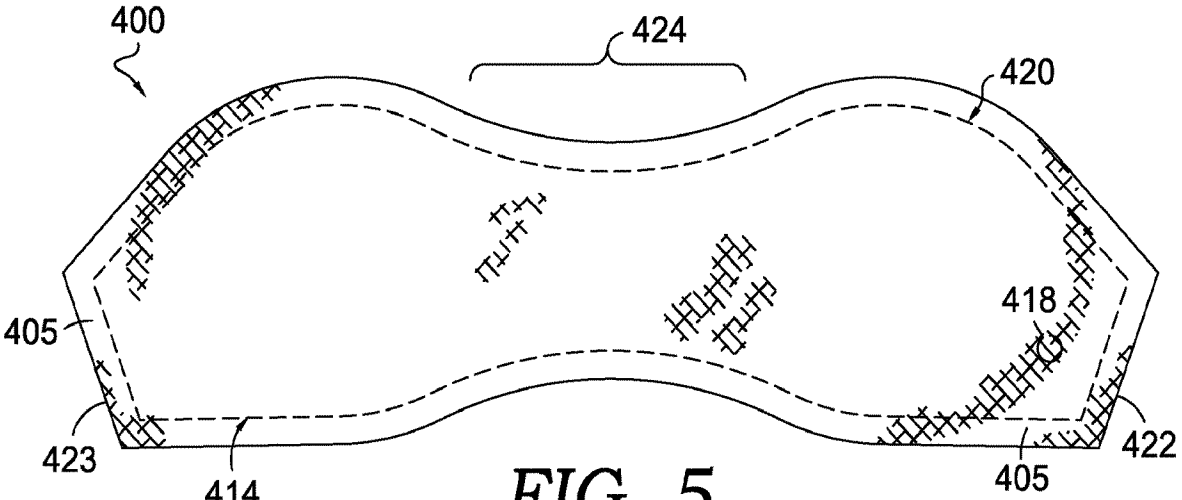
FIG. 5 illustrates a back view of the single-piece pad insert of FIG. 4 in accordance with aspects herein.

Turning now to FIGS. 4 and 5, front (e.g., outer-facing surface) and back (e.g., inner-facing surface) views respectively of an example single-piece pad insert 400 are illustrated in accordance with aspects herein. With respect to FIGS. 4 and 5, and also with respect to FIG. 6A which illustrates a cross-sectional view of the pad insert 400 taken along cut line 6A-6A of FIG. 4, the pad insert 400 comprises a first layer of material 412 that extends generally continuously and without interruption along the outer-facing surface of the pad insert 400 and a second layer of material 414 that extends generally continuously and without interruption along the inner-facing surface of the pad insert 400. It is contemplated herein that the first layer of material 412 and/or the second layer of material 414 may comprise a mesh construction as indicated by reference numerals 416 and 418. The mesh material is only depicted in select locations for illustrative purposes, but it is contemplated herein that an entirety of the first layer of material 412 and an entirety of the second layer of material 414 includes a mesh construction. It is also contemplated herein that the first layer of material 412 and/or the second layer of material 414 may comprise a non-mesh material such as, for instance, a lightweight polyester material. It is also contemplated herein that one or more portions of the first layer of material 412 and/or the second layer of material 414 comprise a mesh material and remaining portions of the first layer of material 412 and the second layer of material 414 comprise a non-mesh material. Any and all aspects, and any variation thereof, are contemplated as being within aspects herein.

Continuing, in example aspects, the first layer of material 412 and the second layer of material 414 may comprise separate pattern pieces affixed together along their respective edges. It is also contemplated herein, that the first layer of material 412 and the second layer of material 414 may comprise a single or unitary piece of material that is folded over to form the front and back of the pad insert 400. In this instance, the single piece of material may be seamed or affixed to itself at one or more edges. Any and all aspects, and any variation thereof, are contemplated as being within aspects herein.

The pad insert 400 further includes an elastically deformable pad portion 420 shown in dashed lines in FIG. 4 to indicate it is generally hidden from view, where the elastically deformable pad portion 420 is positioned between the first layer of material 412 and the second layer of material 414. In example aspects, the elastically deformable pad portion 420 extends continuously and without interruption between a right side margin 422 and a left side margin 423 of the pad insert 400 and between an upper margin 430 and a lower margin 432 of the pad insert 400. The elastically deformable pad portion 420 includes a first breast-contacting surface 434 and a second breast-contacting surface 436 of the pad insert 400. In example aspects, the elastically deformable pad portion 420 comprises an open cell foam to promote the movement of moisture vapor and/or heated air from a wearer's body surface to an external environment. And when combined with the mesh construction of the first layer of material 412 and the second layer of material 414, the moisture vapor and/or heated air may more easily escape into an environment external to the pad insert 400.

Figure 6A:
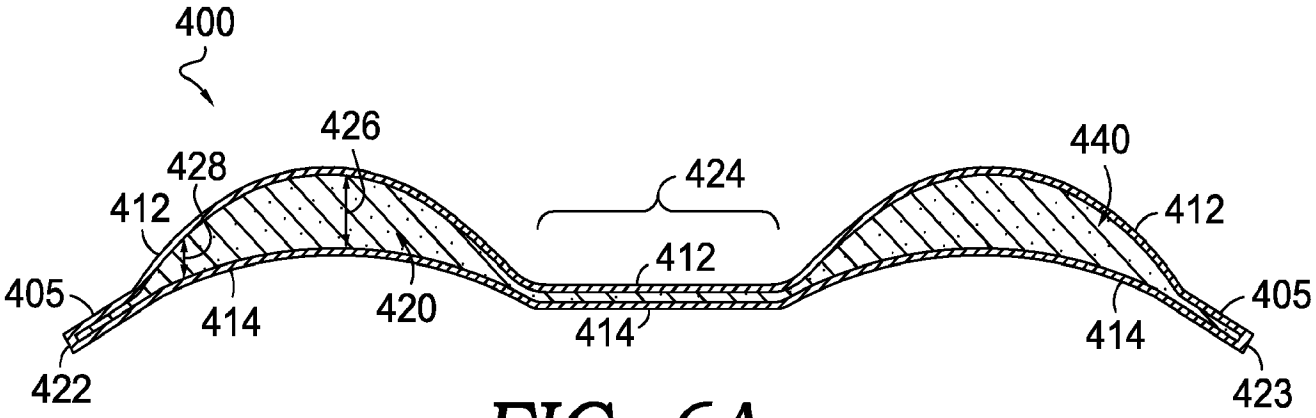
FIG. 6A illustrates a cross-section taken along cut line 6A-6A of FIG. 4 in accordance with aspects herein.

As shown more clearly in FIG. 6A, the elastically deformable pad portion 420 is positioned between the first layer of material 412 and the second layer of material 414. In example aspects, the elastically deformable pad portion 420 is affixed to the first layer of material 412 and/or the second layer of material 414 using, for instance, stitching, spot welding, bonding, adhesives, and the like. By securing the elastically deformable pad portion 420 to the first and/or second layers of material 412 and 414, the elastically deformable pad portion 420 is prevented from becoming displaced during normal wear and during washing.

The pad insert 400 further comprises a central portion 424 that extends between the first breast-contacting surface 434 and the second breast-contacting surface 436. In example aspects, the central portion 424 comprises the first layer of material 412, the second layer of material 414, and the elastically deformable pad portion 420 as shown in FIG. 6A. The elastically deformable pad portion 420 in this area (e.g., the central portion 424) may comprise a negligible thickness such as less than or equal to about 5 mm to minimize the weight of the pad insert 400 and to facilitate flexibility of the pad insert 400 in this area. As used herein, the term "about" means within ±5% of a given value.

The pad insert 400 further comprises material extensions 405 that extend from a right side and a left side of the pad insert 400. The terminal ends of the material extensions 405 form the right side margin 422 and the left side margin 423 of the pad insert 400. The material extensions 405 increase the length of the pad insert 400 and enable the pad insert 400 to substantially fill the pocket space 130 (i.e., occupy at least about 70% but not more than 100% of the pocket space 130) when inserted into the bra 100 thus helping to securely seat the pad insert 400 within the pocket space 130. In example aspects, the material extensions 405 include the first layer of material 412, the second layer of material 414, and the elastically deformable pad portion 420 as shown in FIG. 6A. The elastically deformable pad portion 420 in these areas (e.g., the material extensions 405) may comprise a negligible thickness such as less than or equal to about 5 mm. Minimizing the thickness of the pad portion 420 in these areas enhances the flexibility of the material extensions 405 allowing them to partially wrap around a wearer's sides when the bra 100 and the pad insert 400 are worn by the wearer. This, in turn, limits the displacement of the pad insert 400 during movement. Moreover, minimizing the thickness of the pad portion 420 in the material extensions 405 also helps to make the pad insert 400 lightweight.

With respect to FIGS. 4 and 6A, the elastically deformable pad portion 420 is shaped or configured such that an apex portion 425 (indicated generally by dashed lines in FIG. 4) of the first and second breast-contacting surfaces 434 and 436 has a thickness 426 that is greater than a thickness 428 at a peripheral portion 427 of the first and second breast-contacting surfaces 434 and 436. By making the apex portions 425 thicker than the peripheral portions 427 of the first and second breast-contacting surfaces 434 and 436 of the elastically deformable pad portion 420, greater modesty may be achieved over the wearer's nipple area when the pad insert 400 is utilized. Further, by configuring the first and second breast-contacting surfaces 434 and 436 of the elastically deformable pad portion 420 to be thicker at the apex portions 425 and thinner at the peripheral portions 427, the first and second breast-contacting surfaces 434 and 436 may be able to provide shaping when the pad insert 400 is utilized. Moreover, by using the elastically deformable pad portion 420 in the pad insert 400, the pad insert 400 may provide better support (through, for instance, compression) than use of the pad insert 400 without the elastically deformable pad portion 420. It is contemplated herein that the elastically deformable pad portion 420 may be molded to assume the shape illustrated in FIG. 6A.

In an alternative aspect contemplated herein, instead of the elastically deformable pad portion 420 comprising a single piece that extends continuously from the right side margin 422 to the left side margin 423, the pad insert may include a first elastically deformable pad portion and a separate second elastically deformable pad portion, where each of the first and second elastically deformable pad portions is configured to cover a right breast and a left breast respectively of a wearer when the pad insert is used. In other words, the first elastically deformable pad portion includes a first breast-contacting surface, and the second elastically deformable pad portion includes a second breast-contacting surface. In this aspect, the central portion may include the first layer of material and the second layer of material without an elastically deformable pad portion, and the material extensions may include the first layer of material and the second layer of material without the elastically deformable pad portion. Limiting the elastically deformable pad portion to two separate pad portions each having a respective breast-contacting surface further minimizes the weight of the pad insert and promotes breathability and/or permeability of the pad insert.

Figure 6B:
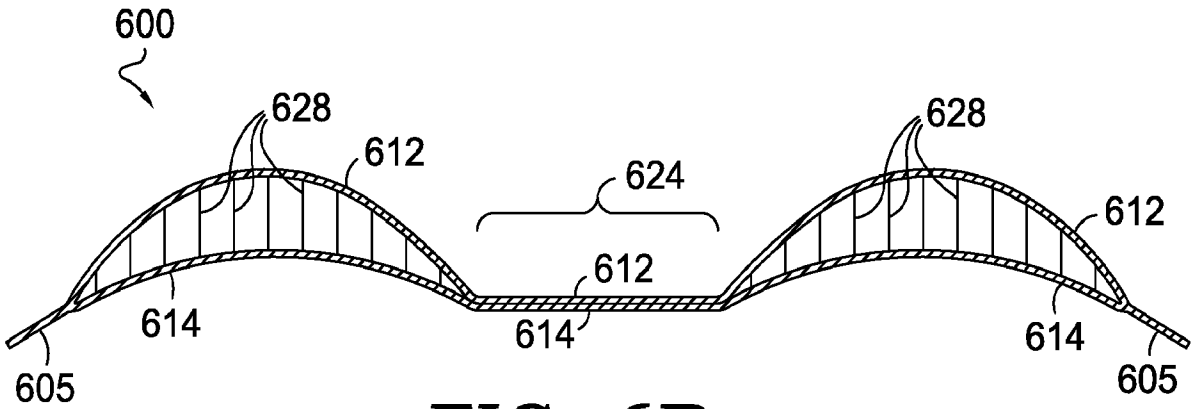
FIG. 6B illustrates an alternative construction where the single-piece pad insert is formed from a spacer mesh material in accordance with aspects herein.

With respect to FIG. 6B, an alternative construction is illustrated for the single-piece pad insert (now labelled 600). It is contemplated herein that the single-piece pad insert 600 may comprise a spacer mesh material having a first layer of material 612 and a second layer of material 614 interconnected by a plurality of tie yarns 628. Thus, instead of the pad insert comprising a first layer of material, a second layer of material, and a separate and distinct elastically deformable pad portion positioned between the first and second layers as described for the pad insert 400, the pad insert 600 may be entirely formed from the spacer mesh material. In example aspects, a length of the tie yarns 628 may be adjusted to be longer at the apex portions of the pad insert 600 and to be shorter at the peripheral portions of the pad insert 600. By having the tie yarns 628 be longer at the apex portions, a greater thickness is achieved at this area to provide more modesty. It is further contemplated herein that the length of the tie yarns 628 may be negligible (e.g., from about 0.1 mm to about 1 mm) at a central portion 624 of the pad insert 600 and at material extensions 605 of the pad insert 600 to provide a more lightweight construction. Similar to the pad insert 400, the spacer mesh material may be molded to assume the shape illustrated in FIG. 6B.

Figure 7:
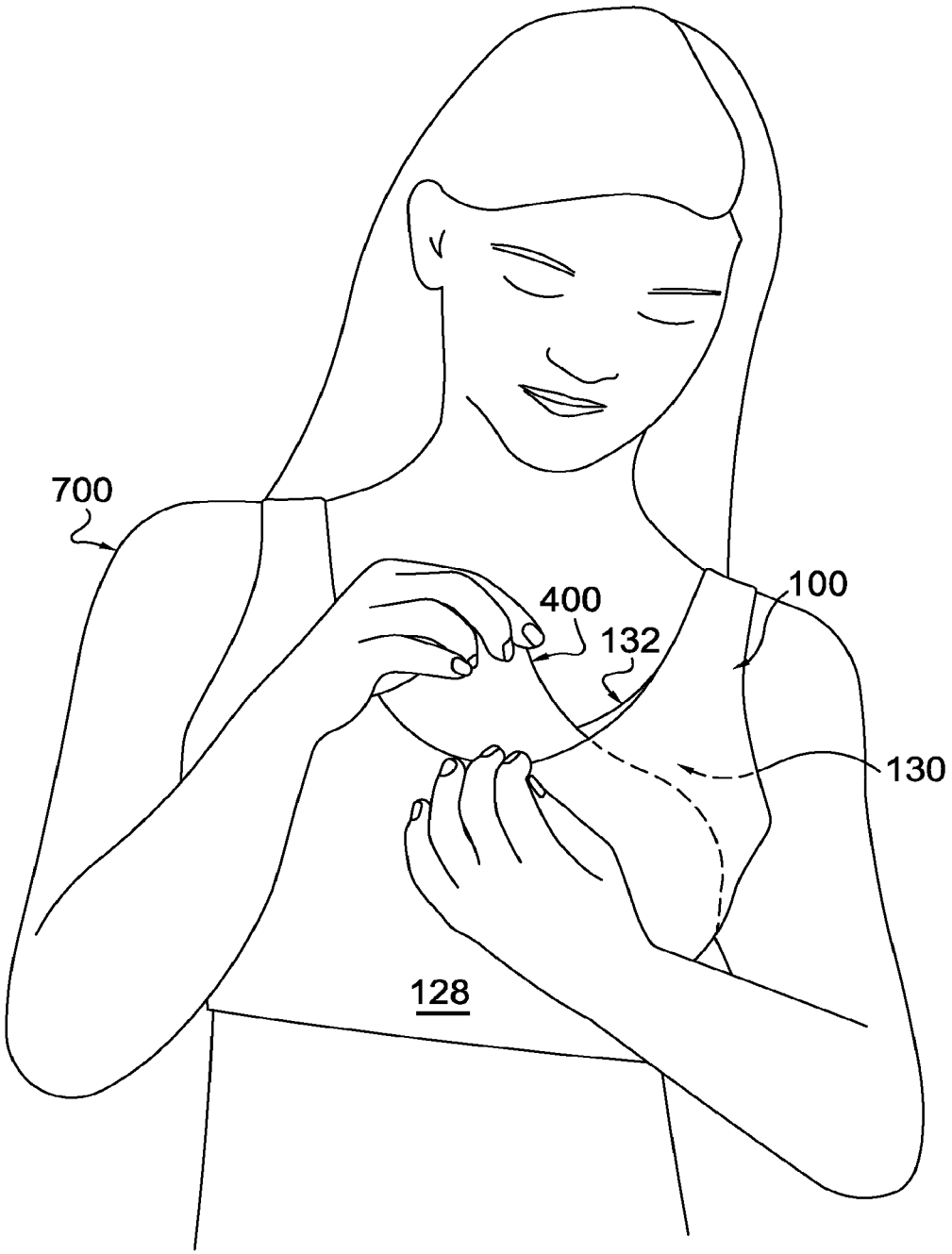
FIG. 7 illustrates a wearer inserting the single-piece pad insert of FIG. 4 into the bra of FIG. 1 by way of the pocket opening in accordance with aspects herein.

Turning now to FIG. 7, a wearer 700 is depicted inserting the pad insert 400 (or the pad insert 600) into the bra 100 in accordance with aspects herein. As shown, the single-piece pad insert 400 can be inserted into the front portion 110 of the bra 100 by inserting the pad insert 400 into the pocket space 130 by way of the pocket opening 132 located at the upper margin 112 of the bra 100. Because of the large pocket opening 132, the pad insert 400 can be easily inserted (and removed) when desired. Moreover, the large pocket opening 132 also allows easy adjustment of the single-piece pad insert 400 once it has been inserted. As shown, the pad insert 400 is being inserted between the first textile layer 126 and the second textile layer 128 of the front portion 110 of the bra 100.

Figure 8:
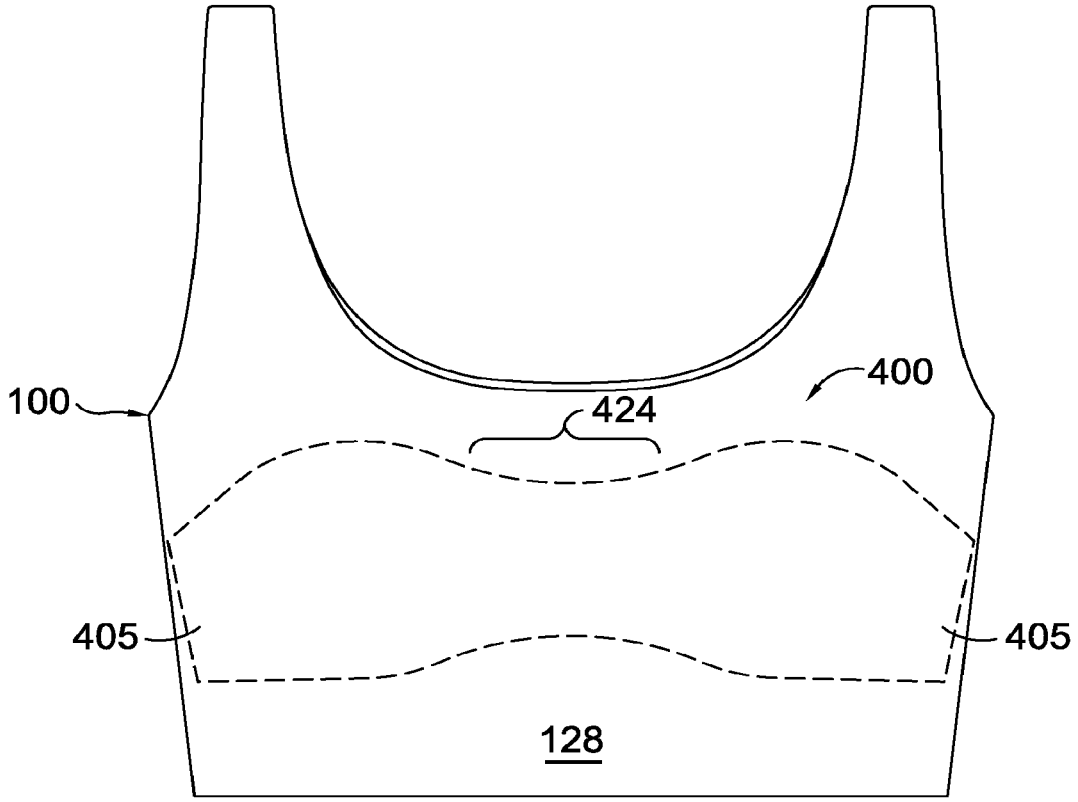
FIG. 8 illustrates the bra of FIG. 1 with the inserted single-piece pad insert of FIG. 4 in accordance with aspects herein.

FIG. 8 depicts a front view of the bra 100 after the single-piece pad insert 400 (or the pad insert 600) has been inserted and positioned in accordance with aspects herein. Once positioned, the first breast-contacting surface 434 of the elastically deformable pad portion 420 is generally aligned with the first breast-contacting surface 122 of the bra 100 (shown in FIG. 1), and the second breast-contacting surface 436 of the elastically deformable pad portion 420 is generally aligned with the second breast-contacting surface 124 of the bra 100 (shown in FIG. 1). Moreover, the central portion 424 of the pad insert 400 is generally aligned with the middle portion 127 of the bra 100 (shown in FIG. 1), and the material extensions 405 are configured to extend partially around the sides of the bra 100. As described above, it is contemplated herein that the first textile layer 126 and/or the second textile layer 128 of the bra 100 may be formed from a textile having stretch and recovery properties. As such, the first and second textile layers 126 and 128 may aid in preventing the pad insert 400 from moving or shifting during wear or movement due to the compressive force exerted on the pad insert 400 by the first and second textile layers 126 and 128.

Figure 9:
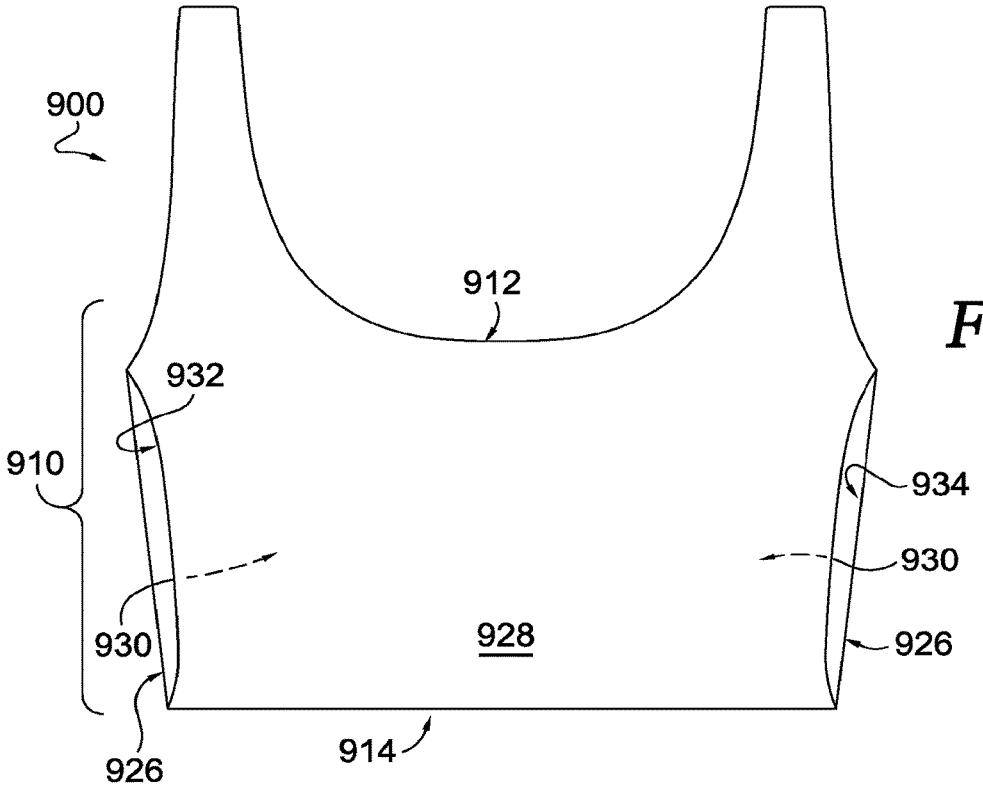
FIG. 9 illustrates a front view of a bra having pocket openings located at the sides of a front portion of the bra in accordance with aspects herein.

With respect to FIG. 9, which is a front view of a bra 900, an alternative configuration is depicted with respect to the pocket location in accordance with aspects herein. Some of the features of the bra 900 are similar to the bra 100 and, as such, will not be described in detail herein. The bra 900 comprises a front portion 910 having an upper margin 912 and a lower margin 914. Similar to the front portion 110 of the bra 100, the front portion 910 may be formed of a first textile layer 926 and a second textile layer 928 where respective surfaces of the first and second textile layers 926 and 928 are positioned adjacent to each other to define a pocket space 930 between the first and second textile layers 926 and 928. However, instead of a pocket opening at the upper margin as shown and described for the bra 100, the bra 900 comprises a first pocket opening 932 at a first side of the bra 900 and a second pocket opening 934 at a second side of the bra 900, where both the first pocket opening 932 and the second pocket opening 934 are in communication with the pocket space 930. It is contemplated herein that the bra 900 may include just the first pocket opening 932 or just the second pocket opening 934 instead of both.

Figure 10:
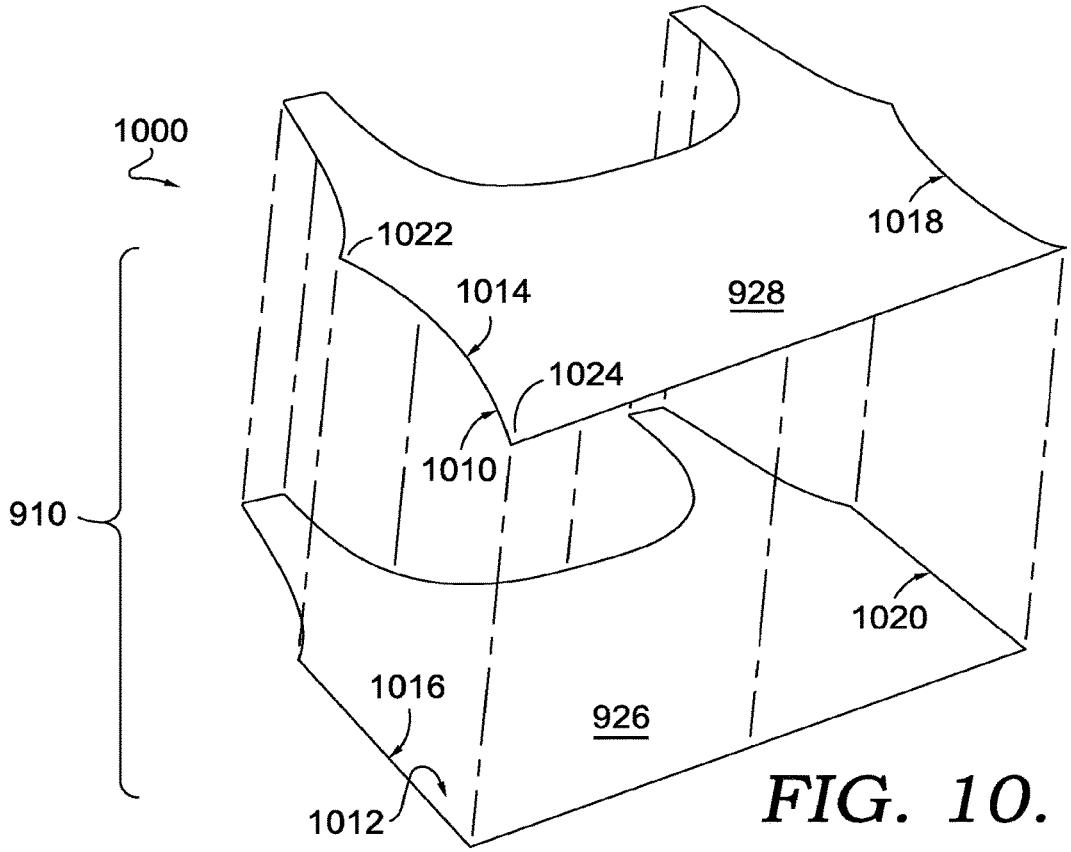
FIG. 10 illustrates an example method of construction of the front portion of the bra of FIG. 9 in accordance with aspects herein.

FIG. 10 illustrates an example method of construction (referenced generally by the numeral 1000) of the front portion 910 of the bra 900 in accordance with aspects herein. The front portion 910 comprises the first textile layer 926 and the second textile layer 928. When assembled, the first textile layer 926 is configured to be positioned adjacent to a body surface of a wearer while the second textile layer 928 is configured to be positioned external to the first textile layer 926. To assemble the front portion 910, a surface 1010 of the second textile layer 928 is positioned adjacent to a surface 1012 of the first textile layer 926, and the second textile layer 928 is affixed to the first textile layer 926 along one or more perimeter edges as generally indicated by the long-and-short lines. For instance, the second textile layer 928 may be affixed to the first textile layer 926 along perimeter edges that form the upper margin 912 and the lower margin 914 of the front portion 910. With respect to this aspect, areas of the front portion 910 that are interior to the perimeter edges are not affixed to one another so that the pocket space 930 is formed between the first and second textile layers 926 and 928. As such, it is contemplated herein that the pocket space 930 may extend generally across an entirety of the front portion 910 from a first side to a second side.

In one example aspect, a first side edge 1014 of the second textile layer 928 may be generally unaffixed from a first side edge 1016 of the first textile layer 126 to form the first pocket opening 932 to the pocket space 930. Similarly, a second side edge 1018 of the second textile layer 928 may be generally unaffixed from a second side edge 1020 of the first textile layer 926 to form the second pocket opening 934 to the pocket space 930. To describe this a different way, and with respect to the first pocket opening 932, the first side edge 1014 of the second textile layer 928 may be affixed to the first side edge 1016 of the first textile layer 926 on both a first side 1022 and a second side 1024 of an unaffixed portion of the first side edge 1014 of the second textile layer 928 where the unaffixed portion comprises the first pocket opening 932 to the pocket space 930. A similar description is applicable to the second pocket opening 934. The attachment points indicated in FIG. 10 and described herein are illustrative only. For example, the front portion 910 may comprise a different shape configuration and may have more or less perimeter edges than shown in FIG. 10.

Figure 11:
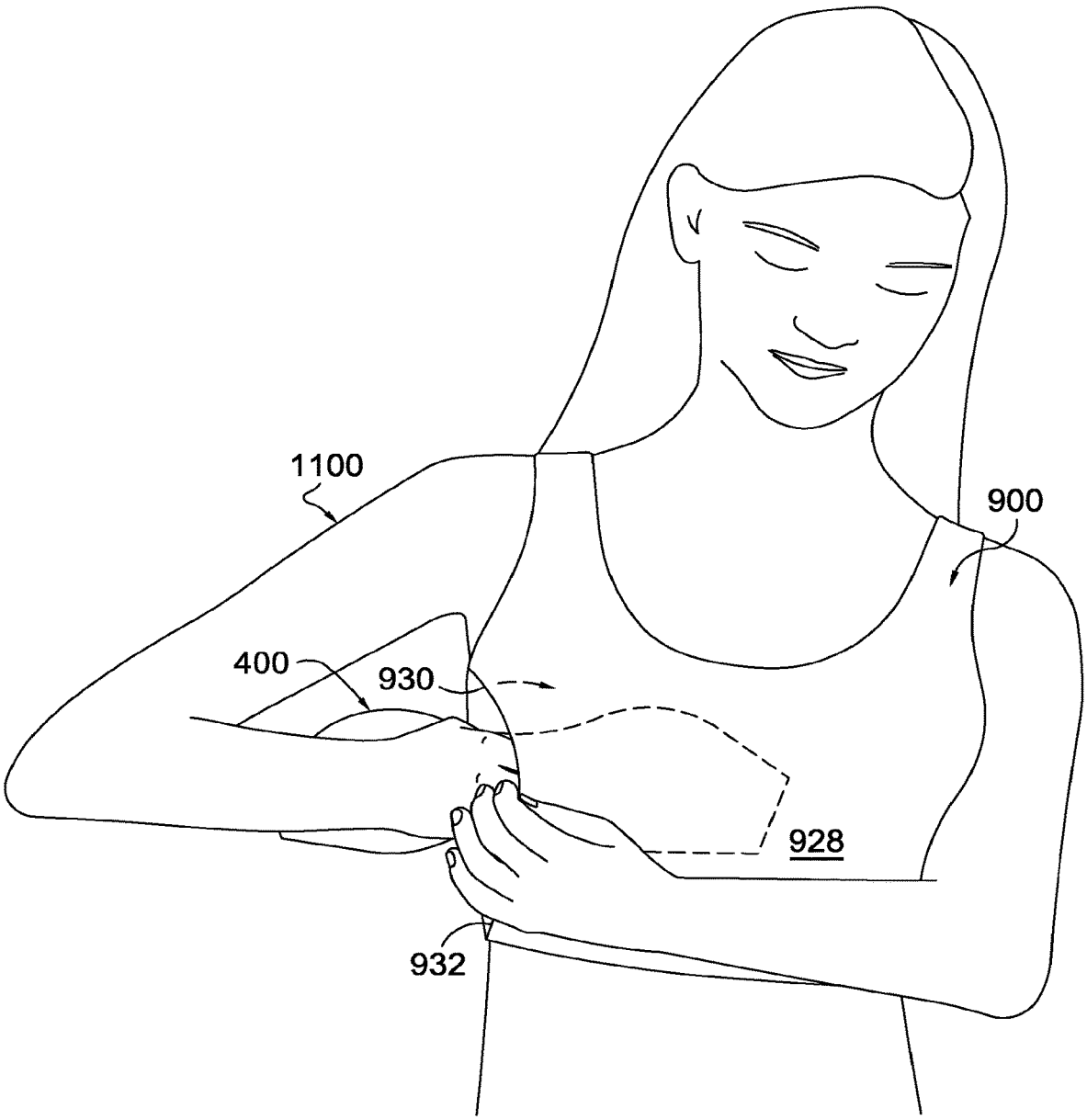
FIG. 11 illustrates a wearer inserting the single-piece insert of FIG. 4 into the bra of FIG. 9 by way of the side pocket openings in accordance with aspects herein.

FIG. 11 depicts a wearer 1100 inserting the pad insert 400 (or the pad insert 600) into the bra 900 in accordance with aspects herein. As shown, the single-piece pad insert 400 can be inserted into the front portion 910 of the bra 900 by inserting the pad insert 400 into the pocket space 930 by way of the first pocket opening 932 located at the side of the bra 900. Alternatively, the wearer 1100 could insert the pad insert 400 using the second pocket opening 934 located at the opposite side of the bra 900. Similar to the bra 100, the first pocket opening 932 is generally large enough to allow easy insertion and removal of the pad insert 400 as well as easy adjustment of the pad insert 400 once it has been inserted. As shown, the pad insert 400 is being inserted between the first textile layer 926 and the second textile layer 928 of the front portion 910 of the bra 900. The pad insert 400 can be removed using either the first pocket opening 932 or the second pocket opening 934.

Figure 12:
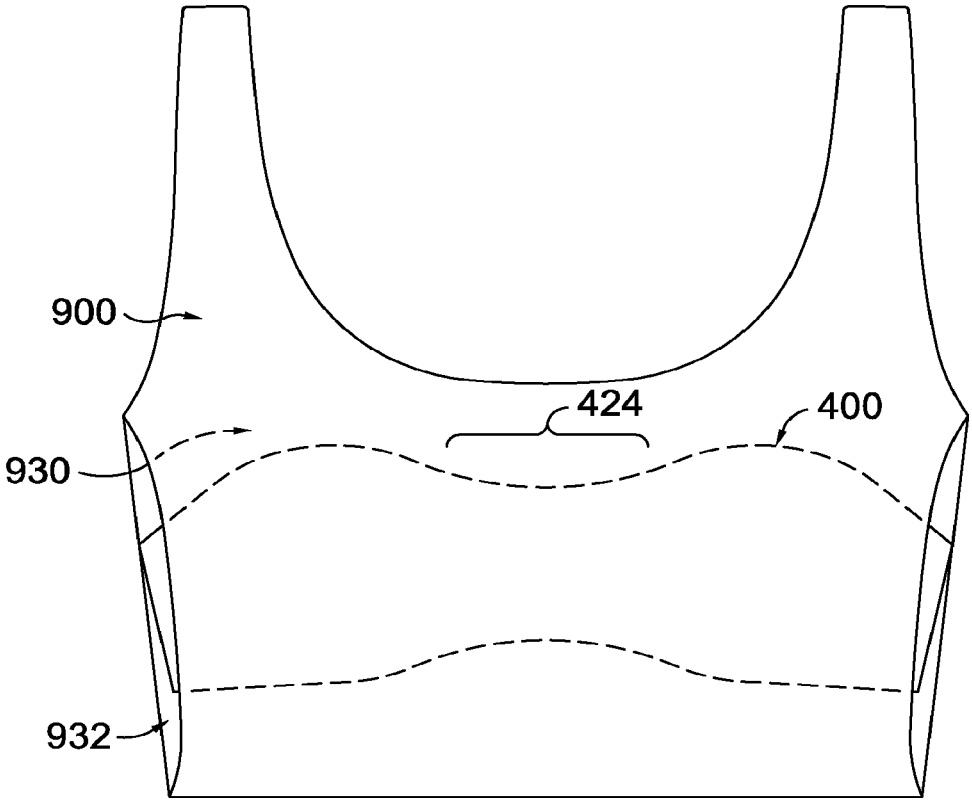
FIG. 12 illustrates the bra of FIG. 9 with the inserted single-piece pad insert of FIG. 4 in accordance with aspects herein.

FIG. 12 depicts a front view of the bra 900 after the single-piece pad insert 400 (or the pad insert 600) has been inserted and positioned in accordance with aspects herein. Similar to above, once positioned, the first breast-contacting surface 434 of the elastically deformable pad portion 420 is generally aligned with a first breast contacting surface of the bra 900, and the second breast-contacting surface 436 of the elastically deformable pad portion 420 is generally aligned with a second breast contacting surface of the bra 100. Moreover, the central portion 424 of the pad insert 400 is generally aligned with a middle portion of the bra 900, and the material extensions 405 are configured to partially extend around the sides of the wearer. Also similar to the bra 100, it is contemplated herein that the first textile layer 926 and/or the second textile layer 928 may be formed from a textile having stretch and recovery properties. As such, the first and second textile layers 926 and 928 may aid in preventing the pad insert 400 from moving or shifting during wear or movement due to the compressive force exerted on the pad insert 400 by the first and second textile layers 926 and 928.

Figure 13:
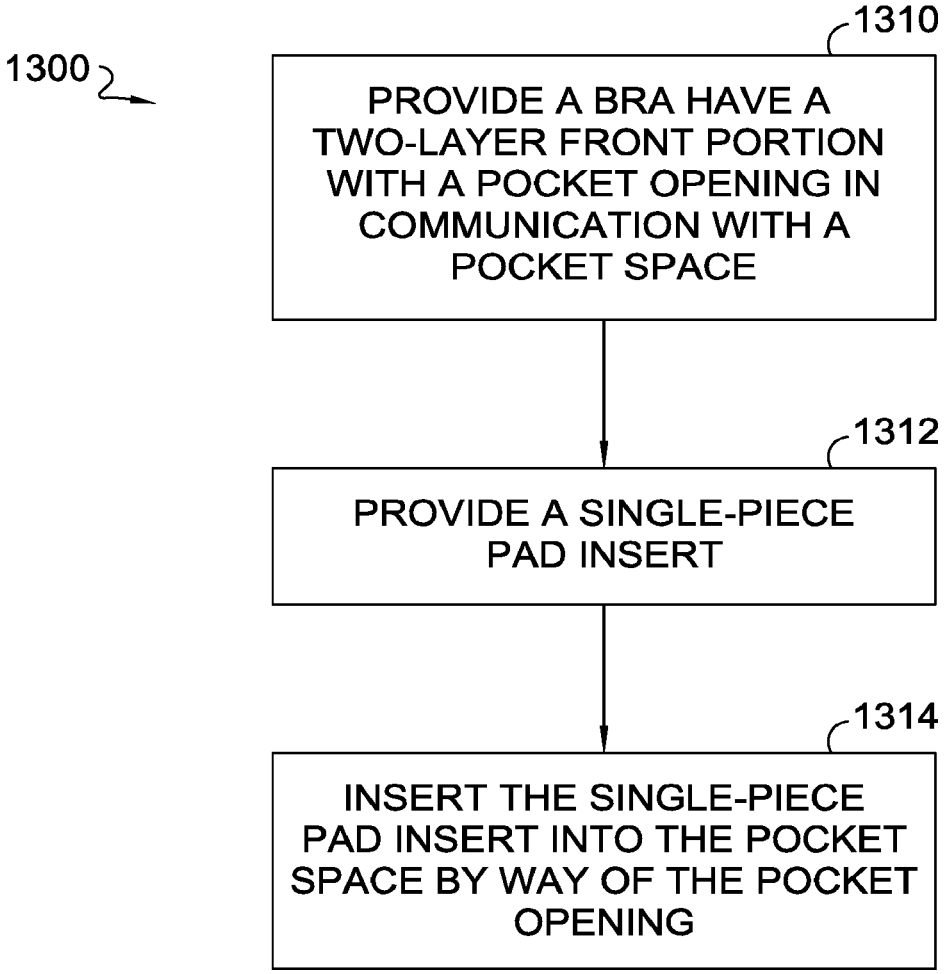
FIG. 13 illustrates an example flow diagram of a method of using a bra having a single-piece pad insert in accordance with aspects herein.

FIG. 13 illustrates a flow diagram of an example method of using a bra having a single piece pad insert and is referenced generally by the numeral 1300. At a step 1310, a bra is provided (e.g., provided by a manufacturer, third-party supplier, retail store, retail outlet, and the like) such as the bra 100 or the bra 900 where the bra comprises a front portion have a two-layer textile construction having a first textile layer and a second textile layer where respective surfaces of the textile layers are positioned adjacent to each other to define a pocket space, such as the pocket space 130 or the pocket space 930, between the textile layers. The front portion of the bra further comprises at last one pocket opening in communication with the pocket space. In example aspects, the pocket opening may be located at an upper margin of the front portion as described in relation to the bra 100. Or there may be first and/or second pocket openings located at the sides of the bra as described with respect to the bra 900. Any and all aspects, and any variation thereof, are contemplated as being within aspects herein.

At a step 1312, a single-piece pad insert, such as the single-piece pad insert 400 or the single-piece pad insert 600, is provided (e.g., provided by a manufacturer, third-party supplier, retail store, retail outlet, and the like), where the pad insert comprises a first layer of material, a second layer of material, and an elastically deformable pad portion positioned between the first layer and the second layer to form a first breast-contacting surface and a second breast-contacting surface.

At a step 1314, the single-piece pad insert is positioned in the pocket space of the bra by way of the pocket opening. This action may occur by a manufacturer, a third-party supplier, a retail store, a retail outlet, and/or a wearer. With respect to a wearer, the wearer may insert the pad insert into the bra when additional modesty, shaping, and/or support is desired. Additional steps may comprise removing the single-piece pad insert by way of the pocket opening after use. Once removed the pocket space in the bra may be useable for stowing other items such as, for instance, identification cards, keys, a cell phone, and the like.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. A bra system comprising:

a bra having a front portion comprising:

a first textile layer, a second textile layer positioned adjacent to the first textile layer to define a pocket space between the first textile layer and the second textile layer, and a pocket opening in communication with the pocket space; and a single-piece pad insert having a first breast-covering portion, a second breast-covering portion, and a central portion extending between and separating the first breast-covering portion and the second breast-covering portion, the single-piece pad insert comprising:

a first layer of material, a second layer of material that is interconnected with the first layer of material by a plurality of tie yarns, the single-piece pad insert configured to be positioned in the pocket space of the front portion of the bra by insertion through the pocket opening;

wherein the single-piece pad insert comprises a first material extension extending from the first breast-covering portion and terminating in a linear right side margin, and a second material extension extending from the second breast-covering portion and terminating in a linear left side margin, each of the first material extension and the second material extension configured to partially curve around sides of a wearer when the bra is in an as-worn configuration;

and wherein a length of the plurality of tie yarns is from about 0.1 mm to about 1 mm at the central portion, the first material extension, and the second material extension.

2. The bra system of claim 1, wherein the pocket opening comprises a first pocket opening positioned at a first side margin of the front portion, and a second pocket opening positioned at a second side margin of the front portion.

3. The bra system of claim 1, the bra further comprising:

a back portion; and a pair of side portions connecting the front portion and the back portion of the bra.

4. The bra system of claim 1, wherein the plurality of tie yarns are interknitted with the first layer of material and the second layer of material.

5. The bra system of claim 1, wherein a length of the plurality of tie yarns is greater at apex portions of the first breast-covering portion and the second breast-covering portion of the single-piece pad insert relative to peripheral portions of the first breast-covering portion and the second breast-covering portion of the single-piece pad insert.

6. The bra system of claim 1, wherein the first layer of material and the second layer of material comprise a mesh construction.

7. A bra system comprising:

a bra having a front portion comprising:

a first textile layer, a second textile layer positioned adjacent to the first textile layer to define a pocket space between the first textile layer and the second textile layer, a first pocket opening in communication with the pocket space, the first pocket opening positioned at a first side margin of the front portion, and a second pocket opening in communication with the pocket space, the second pocket opening positioned at a second side margin of the front portion; and a single-piece pad insert comprising:

a first layer of material, a second layer of material that is interconnected with the first layer of material by a plurality of tie yarns, the single-piece pad insert configured to be positioned in the pocket space of the front portion of the bra by insertion through one or more of the first pocket opening and the second pocket opening;

wherein the single-piece pad insert comprises a first breast-covering portion and a second breast-covering portion, and wherein each of the first breast-covering portion and the second breast-covering portion comprise an apex portion and a peripheral portion;

wherein the single-piece pad insert comprises a central portion extending between and separating the first breast-covering portion and the second breast-covering portion; and wherein a length of the plurality of tie yarns is from about 0.1 mm to about 1 mm at the central portion.

8. The bra system of claim 7, wherein a length of the plurality of tie yarns is greater at the apex portion relative to the peripheral portion.

9. The bra system of claim 7, wherein the single-piece pad insert comprises a first material extension extending from the first breast-covering portion and terminating in a linear right side margin, and a second material extension extending from the second breast-covering portion and terminating in a linear left side margin, each of the first material extension and the second material extension configured to partially curve around sides of a wearer when the bra is in an as-worn configuration.

10. The bra system of claim 9, wherein a length of the plurality of tie yarns is from about 0.1 mm to about 1 mm at each of the first material extension and the second material extension.

11. The bra system of claim 7, wherein each of the first layer of material and the second layer of material comprises a mesh construction.

12. The bra system of claim 7, wherein the plurality of tie yarns are interknitted with the first layer of material and the second layer of material.

* * * * *